US005205212A

United States Patent [19]

Wolfe

[11] Patent Number: 5,205,212

[45] Date of Patent: Apr. 27, 1993

[54] METHOD OF REDUCING INK ELECTRETS IN GRAVURE WEB PRINTING

[76] Inventor: Gene H. Wolfe, c/o R. iR. Donnelley & Sons Co., 77 W. Wacker, 9th Floor, Chicago, Ili. 60601

[21] Appl. No.: 923,322

[22] Filed: Jul. 31, 1992

Related U.S. Application Data

[63] Continuation-in-part of Ser. No. 658,534, Feb. 21, 1991, abandoned, which is a continuation-in-part of Ser. No. 324,674, Mar. 17, 1989, abandoned.

[51] Int. Cl.[5] ..... B41F 9/02; B41F 5/06

[52] U.S. Cl. ..... 101/170; 101/489

[58] Field of Search ..... 101/150, 152, 153, 154, 101/170, 216, 219, 489, 212; 361/225, 214

[56] References Cited

U.S. PATENT DOCUMENTS

| | | | |
|---|---|---|---|
| 2,445,271 | 7/1948 | Huebner | 101/489 |
| 2,654,315 | 10/1953 | Huebner | 101/489 |
| 3,670,203 | 6/1972 | Whitmore, Jr. | 361/225 |

OTHER PUBLICATIONS

Gravure Research Institute Nov. 12, 1963, Burt Zimmerman et al.

*Primary Examiner*—J. Reed Fisher

*Attorney, Agent, or Firm*—Wood, Phillips, Van Santen, Hoffman and Ertel

[57] ABSTRACT

A method of gravure printing utilizing electrostatic assist in the transfer of ink from a printing cylinder to a paper web. The potential of electrets formed in dry ink on the web is minimized by operating the last impression roll and cylinder with a DC potential of the polarity opposite that of the preceding impression rolls.

36 Claims, 5 Drawing Sheets

METHOD OF REDUCING INK ELECTRETS IN GRAVURE WEB PRINTING

RELATED APPLICATIONS

This application is a continuation-in-part of application Ser. No. 658,534, filed Feb. 21, 1991, now abandoned which was a continuation-in-part of application Ser. No. 324,674, filed Mar. 17, 1989, now abandoned.

FIELD OF THE INVENTION

The invention relates to gravure printing and more particularly to gravure printing utilizing electrostatic assist (ESA) in the transfer of ink from a printing cylinder to a paper web.

BACKGROUND OF THE INVENTION

The transfer of ink from gravure cells on a cylinder to the surface of a paper web is enhanced by the application of a DC field between an impression roll and the cylinder, across the web. Ink in a gravure cell has a concave meniscus lying below the cylinder surface. Substantial pressure between the impression roll and cylinder is required for reliable transfer of ink from the cylinder to the web.

It has been found that application of an electrostatic field between the impression roll and cylinder distorts the surface of the ink, causing the ink to extend out of the cell beyond the cylinder surface. Thus, the ink contacts the web in the impression roll-cylinder nip so that the ink transfer is enhanced. George et al. U.S. Pat. No. 4,697,514 shows a method and apparatus for gravure printing with electrostatic assist.

Use of ESA often results in cling, similar to static cling, between the sheets or signatures which are cut and formed from the web. The cling makes it difficult to separate the sheets or to open the signatures causing problems in the bindery or other operations utilizing the printed material.

I have found that the cling is due to the creation of "electrets" in the ink on the web. An electret is a dielectric with a permanent state of electric polarization. When placed in an electric field, dry ink, a dielectric, absorbs electric charges. The absorption results in long-lasting trapped charges in the ink. The ink after absorption produces an electric field. After the electric charge is trapped, surface charge accumulates on the ink. The ink exhibits no external electric field because the surface charge is approximately equal and opposite to the charge in the ink. Eventually, the surface charge dissipates, leaving the charged ink on the web. This electric charge trapped in the ink causes cling.

In accordance with the invention, the potential of the electrets in the ink resulting from use of ESA in a multi-cylinder press are reduced by operating at least one impression roll with a DC potential of the polarity opposite that of another impression roll. More particularly, the impression roll for the last of multiple printing cylinders has a polarity opposite that of the impression rolls for the preceding cylinders.

Another feature is that the method of reducing potential of the electrets in the ink includes the steps of measuring the potential of the printed web caused by the ink electrets downstream from the last cylinder and impression roll and controlling the DC potential of the last impression roll to minimize the measured potential.

Preferably the DC potential is controlled through a feedback circuit.

A further feature of an alternate form of the invention is that an operator observes the measured potential of the printed web while the web is grounded and controls the DC potential of the last impression roll.

Further features and advantages of the invention will be apparent from the following specification and from the drawings, in which.

DETAILED DESCRIPTION OF THE PREFERRED EMBODIMENT

Web gravure presses are used extensively for high volume printing. Typically, the printed web is cut and folded in multipage signatures which are stocked and later assembled into books, as in a bindery. The occurrence of ordinary static electricity on the web causes the sheets or pages of signatures to cling together, making them difficult to handle and to separate for assembly in a book. I have found that the ordinary static electricity results from the formation of electrets in the ink. In accordance with the invention, the potential of ink electrets is reduced so that difficulty in handling the printed web and signatures is minimized.

Figure 1:
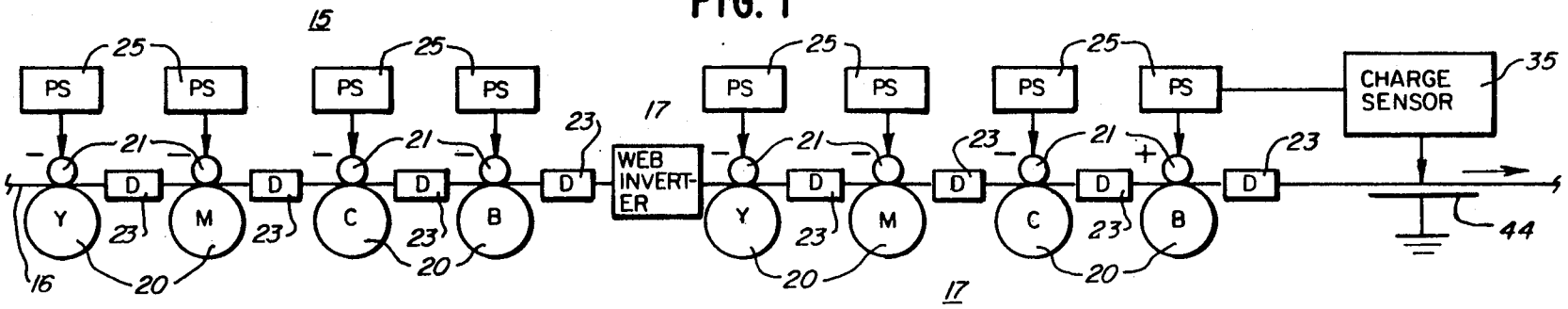
FIG. 1 is a diagrammatic illustration of a four color web press illustrating the invention.

A four color web fed gravure press is illustrated diagrammatically in FIG. 1. The press has a first section 15 for printing one surface of web 16, and a second section 17 for printing the other surface of the web. A web invertor 17 between the two sections reverses the relative positions of the web surfaces. Each press section has four gravure cylinders 20 each of which prints one of the four colors yellow (Y), magenta (M), cyan (C) or black (B). Operably associated with each cylinder 20 is an impression roll 21 which forms a printing nip with the cylinder. The web 16 is drawn from a supply roll (not shown) and passes from left to right as viewed in FIG. 1, serially through the nip for each of the cylinders. The web, printed on both surfaces at the right of FIG. 1, is directed to further processing apparatus, as a slitter, signature folder and stacker (not shown). In each nip ink is transferred from the cylinder to the web. Following each nip, the web 16 passes through a dryer (D) 23 which drives off the ink solvent before the web enters the following impression nip.

Each of the impression rolls 21 is charged to a DC electric potential of the order of several hundred volts, as by connection with a power supply (PS) 25. Each of the printing cylinders 20 is electrically grounded. The electric field established between each impression roll 21 and associated cylinder 20 enhances the transfer of ink from the cylinder 20 to the web 16 as described in the George patent, supra. The impression rolls 21 are preferably of a conductive elastometer; and the printing cylinders 20 are preferably of a metallic conductor.

In a typical ESA gravure printing system, each of the impression rolls is charged to a negative potential. It sometimes occurs that the printed product has a cling, not unlike static cling, that causes printed sheets and signatures to stick together. Sheets and signatures which cling together cannot readily be separated for further processing, as assembly into a book.

I have found that this clinging phenomenon is caused by electrets formed in dry ink on the surface of the paper which is first printed. An electret is an electric charge trapped in a dielectric. For example, in FIG. 1, cylinders 20 of press section 15 print a first surface of web 16. As the other surface of the web is printed by cylinders 20 in section 17, the electric field created by the ESA system creates electrets in the dry ink on the first surface of the web. A general discussion of electrets may be found at Chapter 6, "Electrostatics and its Application", Ed. A. B. Moore (John Wiley & Sons, Inc. 1973).

Figure 2:
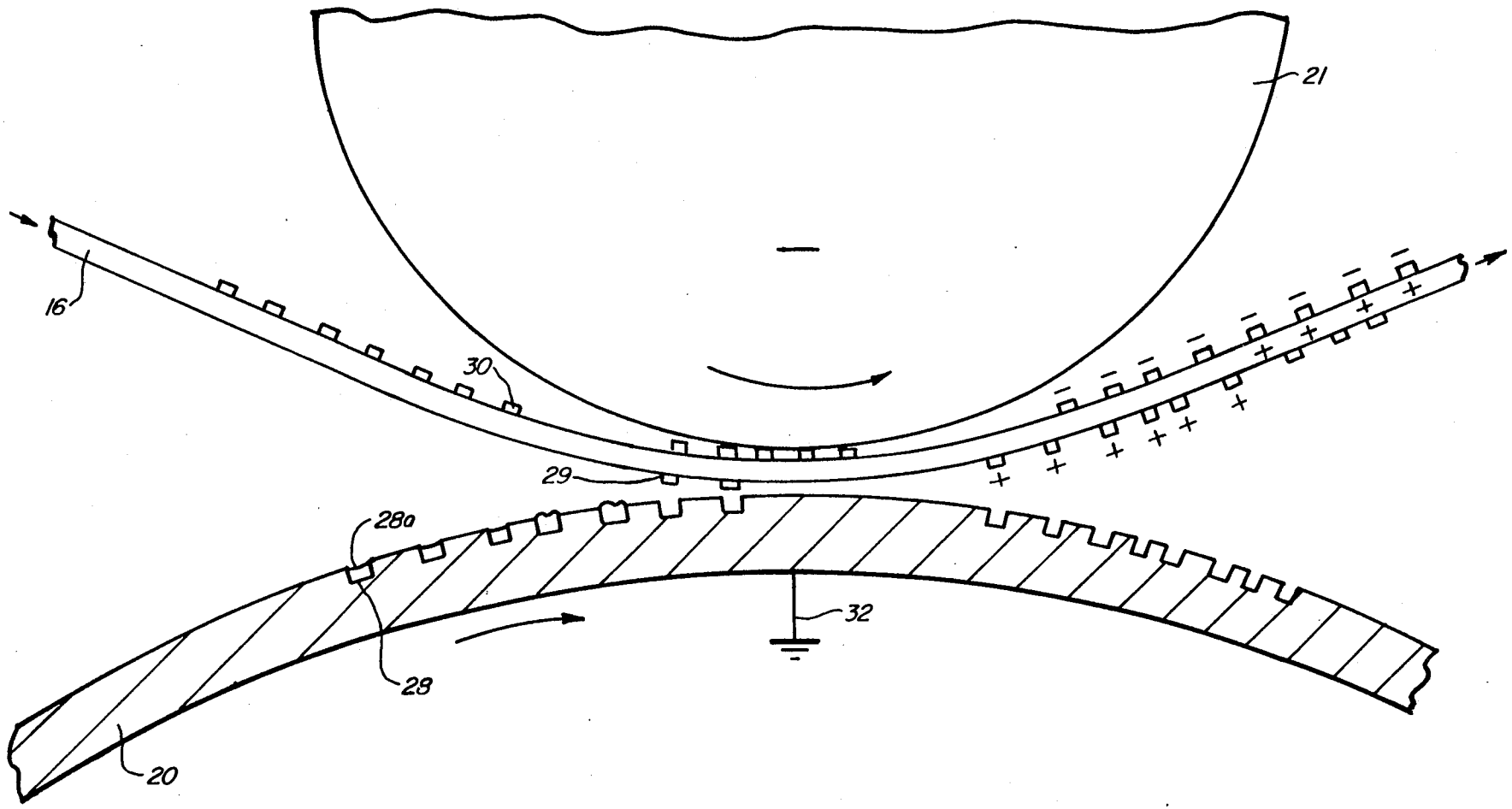
FIG. 2 is an enlarged fragmentary diagram of a cylinder, impression roll and web illustrating the trapped electrostatic charge.

An enlarged representation of the impression nip with ESA is illustrated in exaggerated form in FIG. 2. Web 16 is shown out of contact with both the printing cylinder 20 and impression roll 21. In practice the impression roll holds the web against the cylinder. The ink cells 28 on the surface of the cylinder 20 and the dots of ink 29 and 30 on the lower and upper surfaces of web 16 are exaggerated in both width (or diameter) and thickness. In practice, the cells have a diameter of the order of 100 microns and a depth of the order of 40 microns. The ink dots are the same order of diameter as cells 28 and do not have an appreciable thickness.

The cylinder 20 has a conductive surface as of copper, in which the cells 28 are formed as by diamond or laser engraving. The cylinder is electrically grounded as indicated at 32. Cylinder 21 is of a conductive elastometer and has a negative charge by connection with the negative terminal of a power supply 25. The positive terminal of the power supply (not shown) is grounded.

The cylinder 20 and impression roll 21 illustrated in FIG. 2 are part of press section 17 which prints on the undersurface of web 16, the upper surface of which was printed in press section 15. The ink dots 30 on the upper surface of web 16 are dry as the web approaches the impression nip between cylinder and impression roll. Cells 28 on the cylinder approaching the impression nip are filled with ink from a fountain (not shown). Excess ink is removed from the cylinder surface by a doctor blade (not shown).

Figure 3:
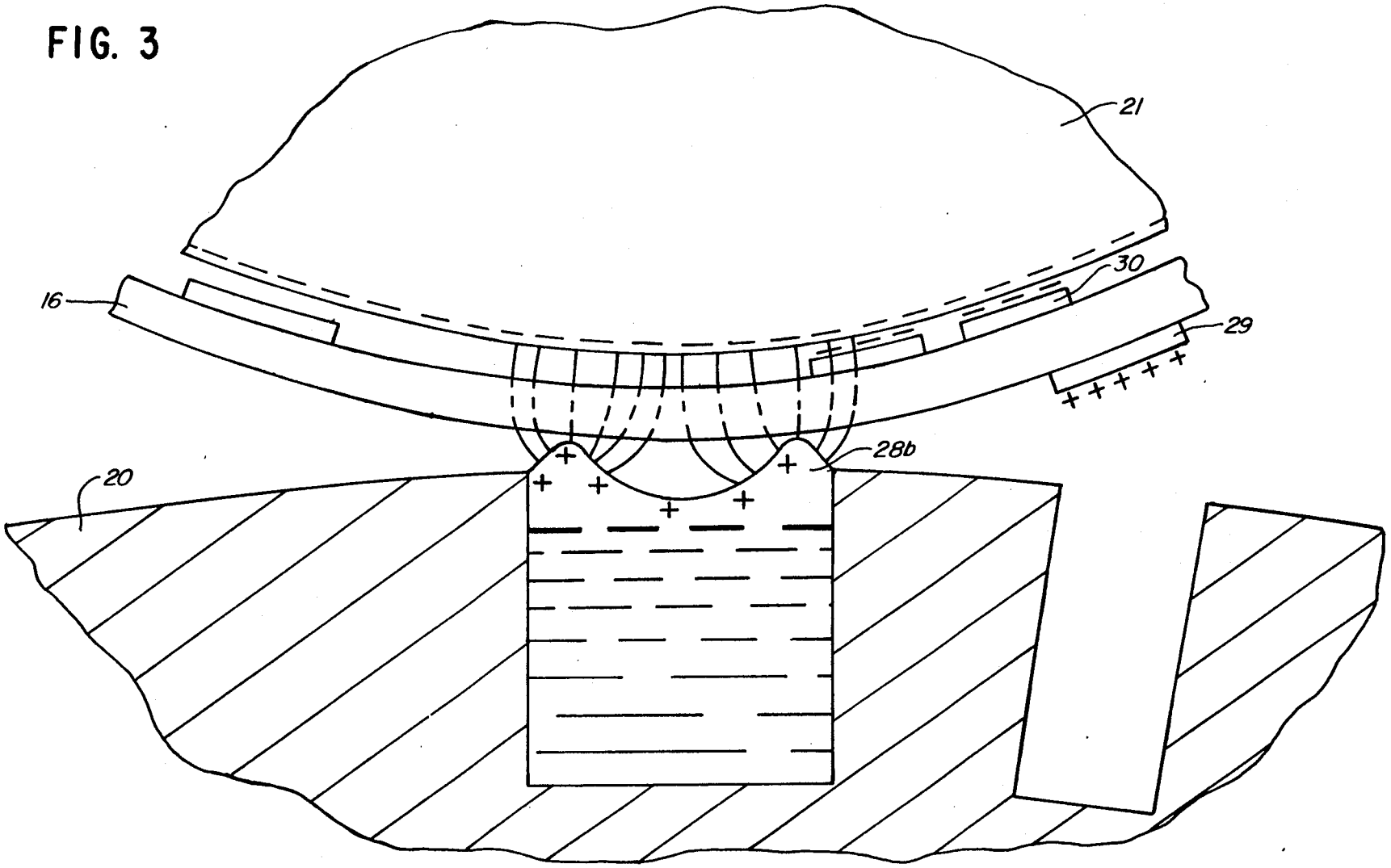
FIG. 3 is an enlarged fragmentary diagram of a cylinder, impression roll and web illustrating the action of ESA in the transfer of ink to the web.

In the absence of an electrostatic field the ink in a cell has a concave meniscus below the surface level of the cylinder 20, as shown at 28*a*. As the cells 28 move closer to the negatively charged impression roll 21, the electrostatic field between the impression roll and the cylinder becomes stronger. The concave meniscus of the ink is distorted as shown in FIG. 3. The peripheral area 28*b* of the ink is drawn outwardly beyond the surface of cylinder 20 and into contact with the surface of web 16, even without a high mechanical force applied between them. However, the intense electric field of the ESA induces the formation of electrets in the dry ink dots 30 on the upper surface of web 16. The charge on the wet ink dots 29 remains mobile and migrates into the paper web to electrically balance the trapped charge.

Electrets form when a charge is trapped in the dry ink. The electrets cause cling. Unlike static electricity, however, the electrets cannot be dissipated by grounding. I have found that the electrets can be neutralized by subjecting them to an electric field with a polarity opposite that of the field that formed them.

Electrets are formed in the ink when the electric field through the web is at least the order of $5\times10^4$ volts/cm. Such an electric field is generated when the potential of the impression cylinder is approximately 500 volts and the thickness of the web is approximately 0.005 cm.

The charge trapped in the electrets formed in the ink on the upper surface of web 16 is particularly large when the upper surface ink has high coverage. The situation is also aggravated where web 16 is coated, reducing the absorption of ink and increasing the resistance of the paper.

In accordance with the invention, the web is subjected to an electric field of the same magnitude, but opposite polarity, as the electric field that created the electrets. Three methods are shown for eliminating the electrets. In one method, at least one of the impression rolls is operated with a potential opposite that of the preceding impression rolls. A second method involves generating an electric field with a charging bar immediately after the impression rolls. Another technique is a combination of operating one impression roll with a potential opposite that of the preceding impression rolls followed by using a charging bar with a polarity the same as that of the final impression roll positioned after the final impression roll.

In the first embodiment of the invention, at least one of the impression rolls, and preferably the last impression roll, is operated with a polarity opposite that of the preceding impression rolls. As shown in FIG. 1, all of the impression rolls 21 except for the last impression roll are operated with a negative potential. The last impression roll is operated with a positive potential approximately equal in magnitude to the negative potential of the other impression cylinders.

The impression cylinder operated at a positive potential is for printing black ink. Yellow, magenta and cyan inks do not transfer well from impression cylinders operating with a positive potential.

Figure 4:
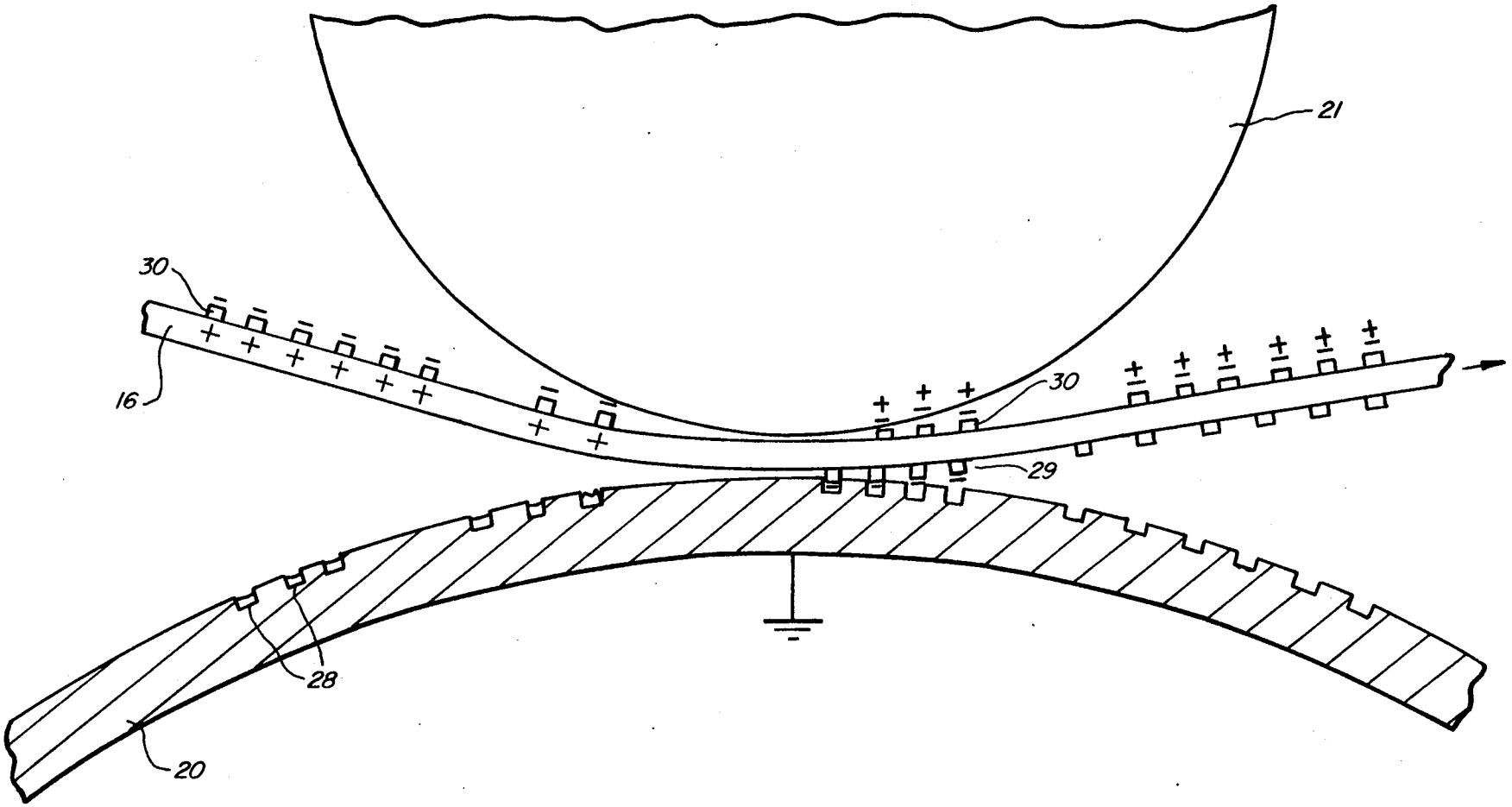
FIG. 4 is an enlarged fragmentary diagram of the cylinder, impression roll and web illustrating the method of the invention in reducing or canceling the trapped electrostatic charge by operating an impression roll with a charge of the opposite polarity.

The effect of the positive potential impression roll 21 is illustrated in FIG. 4. Web 16 approaches the nip with electrets in the dry ink dots 30. As the web passes through the nip, ink from cells 28 transfers to the undersurface of the web as dots 29. The positive electric field generated by the impression roller charge tends to neutralize potential of the electrets.

Adjustment of the voltage of the last impression roll 21 varies the electric field in the dry ink in the last stage nip. If the voltage is too low, all of the electrets are not erased. If the voltage is too high, electrets of an opposite potential are induced in the dry ink.

The voltage of the last impression roll is controlled to minimize the number of electrets formed in the web. As shown in FIG. 1, a charge sensor 35 measures the charge on the upper surface of web 16 downstream from the final dryer 23 and ahead of other processing apparatus as a slitter or signature folder. In the vicinity of the charge sensor, the web is in contact with a grounded metal plate 44.

Grounding of the web near the charge sensor is necessary to accurately measure the surface charge caused by the electrets. Otherwise, static electricity will accumulate on the web, resulting in the sensor measuring the "net" charge of the web, i.e., the static electricity on the web plus the electrets. Grounding of the web eliminates any charge accumulated on the surface, allowing the charge sensor to measure only the potential of the electrets in the dry ink. The charge sensor 35 in turn controls power supply 25 which applies the positive potential to the last impression roll 21 through a feedback circuit 36. The number of electrets in the web is maintained at approximately zero.

Figure 6:
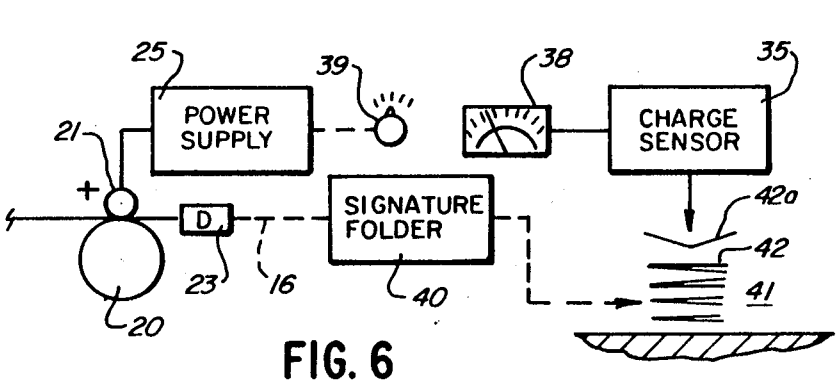
FIG. 6 is a diagrammatic illustration of an operator controlled system in which the trapped charge is measured in a signature.
Figure 5:
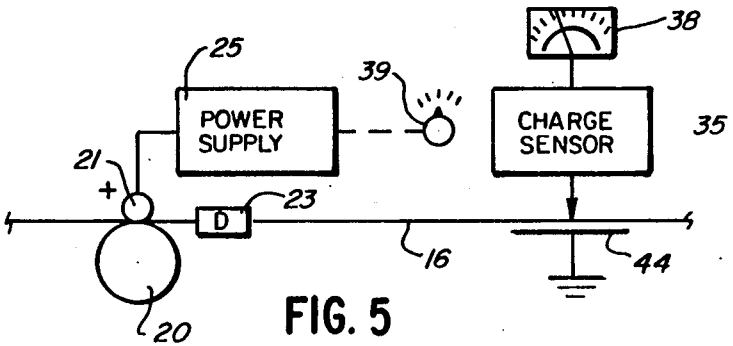
FIG. 5 is a diagrammatic illustration of an operator controlled system in which the trapped charge is measured on the web.

An alternative control is illustrated in FIG. 5 where the charge measured by sensor 35 is displayed as on an analog meter 38. Again, the web is in contact with a grounded metal plate 44 in the vicinity of the meter. An operator observes the meter 38 and manipulates a control 39 to adjust the positive voltage applied by power supply 25 to impression roll 21. A further control is illustrated in FIG. 6. The web 16 is directed from final dryer 23 to a signature folder 40 which delivers the stack 41 of folded signatures 42. The operator opens a signature as shown at 42*a* and measures the electrets with sensor 35. The measured charge is displayed on meter 38 and the operator adjusts control 39 to select the positive potential applied by power supply 25 to impression roll 21. In this manner the charge of the electrets trapped in the dry ink of the printed web is reduced.

Figure 7:
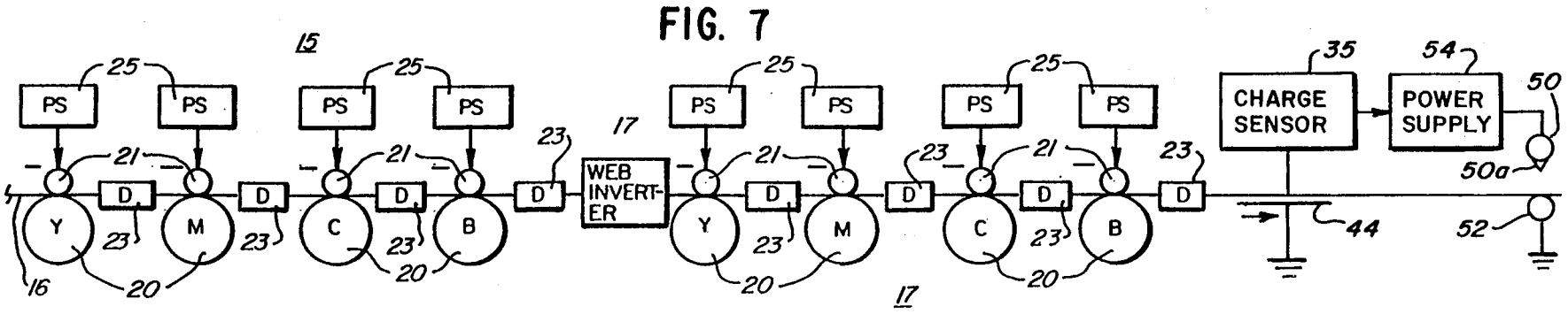
FIG. 7 is a diagrammatic illustration of a second embodiment of the invention.

A second embodiment of the invention, shown in FIG. 7, utilizes charging bar 50. Charging bar 50 is a rod with a plurality of radially extending discrete pointed electrodes pointing toward the web. Charging bar 50 is coupled to power supply 54. The web passes over grounded idler roller 52. Charging bar 50, located above the web and directly over grounded idler roller 52, is energized to a potential of 10,000 to 30,000 volts D.C. with a polarity opposite that of impression rollers 21. Charging bar 50 establishes an electric field of the order of $5\times10^4$ volts/cm through the web, ionizing the air and creating a corona discharge. The electric field substantially eliminates the electrets developed in the web by the impression rollers. As with the first described method, charge sensor 35 may be employed to sense the potential of the electrets trapped in the web by the impression rolls, in order to control the potential of the charging bar. Alternative control methods, such as those previously described, may be used.

Figure 8:
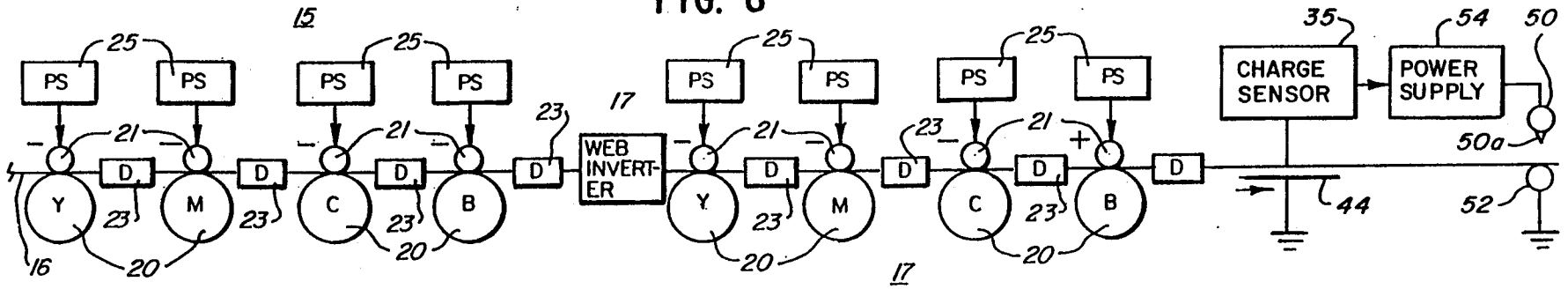
FIG. 8 is a diagrammatic illustration of a third embodiment of the invention.

Another embodiment of the invention is shown in FIG. 8. As in the first embodiment of the invention, the last roll in a series of impression rolls, is energized to a potential equal in magnitude but opposite in polarity of the other impression rolls. Charge sensor 35 positioned after the last impression roll measures the potential of the electrets on the web. As the web passes over ground idler roller 52, charging bar 50 is energized by power supply 52 to a potential dependent upon the potential of the electrets in the web with a sufficient magnitude and polarity to further reduce the potential of the electrets in the web. Again, other methods of controlling the potential of the charging bar, as previously described, may be used.

I claim:

1. In a gravure web press having multiple image cylinders and associated impression rolls forming nips through which a web passes, the press utilizing electrostatic assist with each impression roll operated at a DC potential with respect to the associated gravure cylinder to enhance the transfer of ink from the cylinder to the web, the method of reducing the potential of the electrets in the dry ink on the printed web, which comprises:

creating an electric field in the web by at least one impression roll on the order of $5\times10^4$ volts/cm, such that electric charges are trapped in electrets in the dry ink on the printed web and after electrets form in dry ink on the web, subjecting the web to an electric field opposite in polarity and at least equal in magnitude to the electric field created in the web by the impression rollers and image cylinders.

2. The method of claim 1 in which the electric field is created by operating at least one of the impression rolls with a DC potential of the polarity opposite that of another roll.

3. The method of claim 2 in which the web passes serially through the nips formed between each image cylinder and associated impression roll and the polarity of the DC potential of the last impression roll is opposite that of the preceding impression roll.

4. The method of claim 3 in which the polarity of the last impression roll is opposite that of all preceding impression rolls.

5. The method of claim 4 including the steps of:

measuring the potential of the printed web due to the electrets formed in the ink downstream from the last cylinder and impression roll; and controlling the DC potential of the last impression roll to minimize the measured charge.

6. The method of claim 5 in which the DC potential of the last impression roll is controlled through a feedback circuit.

7. The method of claim 6 in which an operator measures the potential of the web caused by the ink electrets and controls the potential of the last impression roll.

8. The method of claim 7 in which the printed web is processed into folded signatures and the potential of the electrets is measured in a signature.

9. The method of claim 8 in which the folded signature is opened and the potential of the electrets is measured inside the signature.

10. The method of claim 1 in which the electric field is created by directing the web between a grounded roller and a charging bar.

11. The method of claim 10 in which the web passes serially through the nips formed between each image cylinder and associated impression roll and the polarity of the charging bar is opposite that of the preceding impression roll.

12. The method of claim 11 in which the polarity of the charging bar is opposite that of all preceding impression rolls.

13. The method of claim 12 including the steps of:

measuring the potential of the trapped charge in the printed web due to the electrets formed in the ink, downstream from the last cylinder and impression roll; and controlling the DC potential of the charging bar to minimize the measured trapped charge.

14. The method of claim 13 in which the DC potential of the charging bar is controlled through a feedback circuit.

15. The method of claim 14 in which an operator measures the potential of the web caused by the ink electrets and controls the potential of the charging bar.

16. The method of claim 15 in which the printed web is processed into folded signatures and the potential of the electrets is measured in a signature.

17. The method of claim 16 in which the folded signature is opened and the potential of the electrets is measured inside the signature.

18. The method of claim 3 in which the web, after passing through the nip formed by the last impression roll and associated gravure cylinder, is subjected to an electric field opposite that of the last impression roll.

19. The method of claim 18 in which the polarity of the last impression roll is opposite that of all preceding impression rolls.

20. The method of claim 18 including the steps of:
measuring the potential of the printed web due to the electrets formed in the ink downstream from the last cylinder and impression roll; and
controlling the DC potential of the charging bar to minimize the measured charge.

21. The method of claim 20 in which the DC potential of the charging bar is controlled through a feedback circuit.

22. The method of claim 20 in which an operator measures the potential of the web caused by the ink electrets and controls the potential of the charging bar.

23. The method of claim 20 in which the printed web is processed into folded signatures and the potential of the electrets is measured in a signature.

24. The method of claim 20 in which the folded signature is opened and the potential of the electrets is measured inside the signature.

25. In a multicolor gravure press for printing both surfaces of a web, the press having a plurality of image cylinders, each with an associated impression roll forming a printing nip, the web passing serially through the nips of the cylinders and impression rolls, the cylinders and rolls being in a first section through which the web first passes for printing one surface of the web and a second section through which the web second passes for printing the second surface of the web, at least two impression rolls of the second section having a DC electric charge for electrostatic assist in transferring ink from the cylinder to the web, the method of reducing the potential of the electrets which comprises creating an electric field in the web by the first of said charged rolls on the order of $5\times10^4$ volts/cm such that an electric charge is trapped in the dry ink on the printed web, and subjecting the web to a potential at least equal in magnitude and opposite in polarity to the electric field created in the web by the impression rollers and image cylinders.

26. The method of claim 25 where the electric field is created by operating the last charged impression roll with a DC potential of the polarity opposite the polarity of the electrets.

27. The method of claim 26 in which all of the impression rolls of the first section and all of the impression rolls of the second section, except the last roll of the second section, have a DC potential of the same polarity and the last impression roll of the second group has a DC potential of the opposite polarity.

28. The method of claim 27 in which the last impression roll is operated with a positive DC potential and the other impression rolls are operated with a negative DC potential.

29. The method of claim 28 including the steps of:
measuring the potential of the trapped charge of electrets on the one surface of the web while the web is grounded; and
controlling the DC potential of the last impression roll to minimize the trapped charge.

30. The method of claim 25 in which the electric field is created by placing the web between a charging bar and ground.

31. The method of claim 25 including the steps of:
measuring the potential of the trapped charge in the printed web due to the electrets formed in the ink, downstream from the last cylinder and impression roll; and
controlling the DC potential of the charging bar to minimize the trapped charge.

32. The method of claim 31 in which the DC potential of the charging bar is controlled through a feedback circuit.

33. The method of claim 32 in which an operator measures the potential of the web caused by the ink electrets and controls the potential of the last impression roll.

34. The method of claim 33 in which the printed web is processed into folded signatures and the potential of the electrets is measured in a signature.

35. The method of claim 33 in which the folded signature is opened and the potential of the electrets is measured inside the signature.

36. The method of claim 28 including the steps of:
measuring the potential of electrets on the one surface of the web while the web is grounded;
placing the web between ground and a charging bar; and
controlling the DC potential of the charging bar to minimize the measured charge.

* * * * *